US008806679B2

(12) United States Patent
Soto et al.

(10) Patent No.: US 8,806,679 B2
(45) Date of Patent: Aug. 19, 2014

(54) OPERATING ROOM TABLE ADAPTER

(75) Inventors: Orlando Soto, Acton, MA (US); Dustin T. Libby, Belmont, MA (US); Thomas K. Skripps, Acton, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 674 days.

(21) Appl. No.: 12/948,820

(22) Filed: Nov. 18, 2010

(65) Prior Publication Data

US 2012/0124742 A1 May 24, 2012

(51) Int. Cl.
*A61G 13/10* (2006.01)
*A61G 13/12* (2006.01)

(52) U.S. Cl.
CPC ..... *A61G 13/101* (2013.01); *A61G 13/129* (2013.01); *A61G 13/1225* (2013.01); *A61G 13/121* (2013.01)
USPC ..... 5/600; 5/622; 5/637; 5/507.1

(58) Field of Classification Search
USPC ..... 5/600, 601, 621, 622
See application file for complete search history.

(56) References Cited

U.S. PATENT DOCUMENTS

| | | | | |
|---|---|---|---|---|
| 320,806 | A | | 6/1885 | Long |
| 933,471 | A | | 9/1909 | Leahy |
| 1,728,025 | A | | 9/1929 | Weber |
| 2,306,031 | A | | 12/1942 | Anderson et al. |
| 2,452,816 | A | | 11/1948 | Wagner |
| 2,509,086 | A | | 5/1950 | Eaton |
| 2,688,142 | A | | 9/1954 | Jensen |
| 3,042,025 | A | | 7/1962 | Jackson |
| 3,099,441 | A | | 7/1963 | Ries |
| 3,188,079 | A | | 6/1965 | Boetcker et al. |
| 3,223,447 | A | | 12/1965 | Terracini |
| 3,572,835 | A | | 3/1971 | Kees, Jr. et al. |
| 3,609,779 | A | | 10/1971 | Oja et al. |
| 3,828,377 | A | | 8/1974 | Fary, Sr. |
| 3,840,221 | A | * | 10/1974 | Hogan ..... 5/601 |
| 3,854,772 | A | | 12/1974 | Abrahamson et al. |
| 3,897,777 | A | | 8/1975 | Morrison |
| 3,947,686 | A | | 3/1976 | Cooper et al. |
| 3,957,262 | A | | 5/1976 | McReynolds |
| 4,018,412 | A | | 4/1977 | Kees, Jr. et al. |
| 4,021,028 | A | | 5/1977 | Weber et al. |
| 4,033,339 | A | | 7/1977 | Roberts et al. |
| 4,034,748 | A | | 7/1977 | Winner |

(Continued)

FOREIGN PATENT DOCUMENTS

WO WO 2005/020819 3/2005

OTHER PUBLICATIONS

2005 Catalog Passionate About Positioning, Allen Medical Systems, A Hill-Rom Company; dated Dec. 2004.

*Primary Examiner* — Brittany Wilson
(74) *Attorney, Agent, or Firm* — Barnes & Thornburg LLP

(57) ABSTRACT

An operating room table adapter is disclosed herein for use with a surgical table includes an adapter board, a rail receiver, and a rail assembly. The adapter board includes a slot formed in the adapter board and a strap extending through the slot. The adapter board has a first side including a first coupler. The first coupler is configured to engage a coupler of the surgical table and the strap is configured to wrap around at least a portion of the surgical table. The rail assembly extends beyond an edge of the adapter board and is operable to couple to a patient support.

16 Claims, 7 Drawing Sheets

(56) References Cited

U.S. PATENT DOCUMENTS

| | | | |
|---|---|---|---|
| 4,054,282 | A | 10/1977 | Hamer |
| 4,108,426 | A | 8/1978 | Lindstroem et al. |
| 4,139,917 | A | 2/1979 | Fenwick |
| 4,169,478 | A | 10/1979 | Hickmann |
| 4,225,125 | A | 9/1980 | Lee |
| 4,243,025 | A | 1/1981 | Jones |
| 4,378,108 | A | 3/1983 | Bailey, Jr. |
| 4,387,888 | A | 6/1983 | Marinakis |
| D271,834 | S | 12/1983 | Huntsinger |
| 4,474,364 | A | 10/1984 | Brendgord |
| 4,484,911 | A | 11/1984 | Berlin et al. |
| 4,504,050 | A | 3/1985 | Osborne |
| 4,526,355 | A | 7/1985 | Moore et al. |
| 4,545,572 | A | 10/1985 | Day |
| 4,620,697 | A | 11/1986 | Pithon |
| 4,671,728 | A | 6/1987 | Clark et al. |
| 4,678,232 | A | 7/1987 | Ishida et al. |
| 4,752,064 | A | 6/1988 | Voss |
| 4,757,983 | A | 7/1988 | Ray et al. |
| 4,823,776 | A | 4/1989 | Foster et al. |
| 4,840,363 | A | 6/1989 | McConnell |
| 4,852,840 | A | 8/1989 | Marks |
| 4,865,484 | A | 9/1989 | McConnell |
| 4,923,187 | A | 5/1990 | Mombrinie |
| 4,979,519 | A | 12/1990 | Chavarria et al. |
| 4,989,848 | A | 2/1991 | Monroe |
| 4,995,067 | A | 2/1991 | Royster et al. |
| 5,081,665 | A | 1/1992 | Kostich |
| 5,088,706 | A | 2/1992 | Jackson |
| 5,131,106 | A | 7/1992 | Jackson |
| 5,177,823 | A | 1/1993 | Riach |
| 5,207,716 | A | 5/1993 | McReynolds et al. |
| 5,214,815 | A | 6/1993 | Agbodoe et al. |
| 5,220,699 | A | 6/1993 | Farris |
| 5,233,713 | A | 8/1993 | Murphy et al. |
| 5,269,035 | A | 12/1993 | Hartunian |
| 5,276,927 | A | 1/1994 | Day |
| 5,317,771 | A | 6/1994 | Cook |
| 5,408,713 | A | 4/1995 | Stratton et al. |
| 5,427,436 | A | 6/1995 | Lloyd |
| 5,444,882 | A | 8/1995 | Andrews et al. |
| 5,515,867 | A | 5/1996 | Lamb |
| 5,520,623 | A | 5/1996 | Williams |
| 5,524,639 | A | 6/1996 | Lanier et al. |
| 5,531,229 | A | 7/1996 | Dean et al. |
| 5,564,663 | A | 10/1996 | Cook et al. |
| 5,569,175 | A | 10/1996 | Chitwood |
| 5,613,254 | A | 3/1997 | Clayman et al. |
| 5,613,501 | A | 3/1997 | Michelson |
| 5,615,432 | A | 4/1997 | Von Ohlen, III |
| 5,642,302 | A | 6/1997 | Dumont et al. |
| 5,661,859 | A | 9/1997 | Schaefer |
| 5,741,210 | A | 4/1998 | Dobrovolny |
| 5,758,374 | A | 6/1998 | Ronci |
| 5,916,189 | A | 6/1999 | Sullenperger et al. |
| 5,926,876 | A | 7/1999 | Haigh et al. |
| D414,974 | S | 10/1999 | Marrone, II et al. |
| 5,960,494 | A | 10/1999 | Gilliland et al. |
| 6,065,165 | A | 5/2000 | Delk et al. |
| 6,076,208 | A | 6/2000 | Heimbrock et al. |
| 6,108,840 | A | 8/2000 | Heimbrock et al. |
| 6,112,333 | A | 9/2000 | Mazzei |
| 6,120,397 | A | 9/2000 | Julian |
| 6,138,302 | A | 10/2000 | Sashin et al. |
| 6,138,304 | A | 10/2000 | Lipsky et al. |
| 6,151,734 | A | 11/2000 | Lawrie |
| 6,154,903 | A | 12/2000 | Wai-Chung |
| 6,199,552 | B1 | 3/2001 | Crespo |
| 6,202,230 | B1 | 3/2001 | Borders |
| 6,249,923 | B1 | 6/2001 | Heimbrock et al. |
| 6,260,220 | B1 | 7/2001 | Lamb et al. |
| 6,276,012 | B2 | 8/2001 | Borders |
| 6,374,439 | B2 | 4/2002 | Heimbrock et al. |
| 6,397,414 | B1 | 6/2002 | Lloyd |
| 6,427,273 | B1 | 8/2002 | Berke et al. |
| 6,442,777 | B1 | 9/2002 | Pauli |
| 6,446,287 | B2 | 9/2002 | Borders |
| 6,490,737 | B1 | 12/2002 | Mazzei et al. |
| 6,510,852 | B1 | 1/2003 | Shiery et al. |
| 6,532,609 | B2 | 3/2003 | Taylor et al. |
| 6,557,195 | B2 | 5/2003 | Dinkler |
| 6,561,194 | B2 | 5/2003 | Michelson |
| 6,564,406 | B2 | 5/2003 | VanSteenburg et al. |
| 6,578,215 | B1 | 6/2003 | Heimbrock et al. |
| 6,594,839 | B1 | 7/2003 | Papay |
| 6,616,236 | B1 | 9/2003 | Su |
| 6,622,324 | B2 | 9/2003 | VanSteenburg et al. |
| 6,637,058 | B1 | 10/2003 | Lamb |
| 6,701,553 | B1 | 3/2004 | Hand et al. |
| 6,718,580 | B2 | 4/2004 | Heimbrock et al. |
| 6,718,582 | B1 | 4/2004 | Tinsley |
| 6,739,006 | B2 | 5/2004 | Newkirk et al. |
| 6,754,923 | B2 | 6/2004 | Borders et al. |
| D497,430 | S | 10/2004 | Tinsley |
| 6,928,676 | B1 | 8/2005 | Schwaegerle |
| 7,017,211 | B2 | 3/2006 | Krywiczanin et al. |
| 7,089,613 | B2 | 8/2006 | Cohen |
| 7,117,551 | B1 | 10/2006 | Dinkler et al. |
| 7,407,231 | B2 | 8/2008 | Kraft et al. |
| 7,544,007 | B2 | 6/2009 | Easton |
| 7,770,977 | B2 | 8/2010 | Diller |
| 7,882,583 | B2 | 2/2011 | Skripps |
| 2002/0061225 | A1 | 5/2002 | Boucher et al. |
| 2003/0115674 | A1 | 6/2003 | Heimbrock et al. |
| 2004/0123389 | A1 | 7/2004 | Boucher et al. |
| 2006/0253985 | A1 | 11/2006 | Skripps |
| 2008/0078031 | A1 | 4/2008 | Weinstein et al. |
| 2009/0079251 | A1 | 3/2009 | Diller |

* cited by examiner

OPERATING ROOM TABLE ADAPTER

BACKGROUND

The present disclosure relates to a patient support apparatus, for supporting a patient during surgery. More particularly, the present disclosure relates to an operating room table adapter for coupling a patient support or brace to a surgical table.

Often, when a patient is sedated for a surgery, the patient is supported by and secured to braces or supports coupled to a surgical table. Sometimes, an operating room table adapter is used to adapt the attachment features of braces or supports to the surgical table.

Operating room table adapters known in the art often include a series of couplers such as clamps or bolts for coupling the operating room table adapter to the surgical table. Such operating room table adapters can be difficult to couple to the surgical table.

SUMMARY

An operating room table adapter has one or more of the features recited in the appended claims and/or the following features which, alone or in any combination, may comprise patentable subject matter:

An operating room table adapter for use with a surgical table having a table coupler on a table section is disclosed. The operating room table adapter may include an adapter board, at least one rail, and at least one strap. The adapter board may include a first side having a first coupler and at least one slot formed through the adapter board. The at least one rail may be coupled to the adapter board and may extend beyond a first edge thereof. The at least one strap may extend through the at least one slot. Further, the first coupler of the adapter board may be configured to engage the table coupler of the table section and the at least one strap may be configured to wrap around at least a portion of the surgical table section to secure the adapter board in place on the surgical table.

It is contemplated that the adapter board may include a second side opposing the first side and the strap may extend through the first side and the second side. In some embodiments, the adapter board may include at least two slots. The first slot and the second slot may extend through the first side and the second side of the adapter board. The first slot and the second slot may also be spaced a first distance and a second distance, respectively, from the first edge of the adapter board. The adapter board may also include a second edge substantially parallel to the first edge. The first slot and the second slot may be spaced a third distance and a fourth distance from the second edge, respectively.

The operating room table adapter may include a rail receiver coupled to the adapter board. The rail receiver may have a rail opening sized to receive the at least one rail. The size of the rail opening may be adjustable to a released configuration allowing slidable movement of the at least one rail relative to the rail opening and to a clamped configuration preventing slidable movement of the at least one rail relative to the rail opening. The rail receiver may include a rail lock having a lock bolt. The lock bolt may be rotatable to adjust size of the rail opening between the released configuration and the clamped configuration. The rail opening may be spaced apart from the adapter board a distance sufficient for the table section to be situated between the adapter board and the at least one rail.

According to this disclosure, therefore, an operating room table adapter is adapted for use with the surgical table described above and a mattress having a mattress coupler on a surface of the mattress. The operating room table adapter may include an adapter board and at least one rail. The adapter board may have a first side having a first coupler and a second side having a second coupler. The at least one rail may be coupled to the adapter board and may extend beyond a first edge thereof. The first coupler may be configured to couple with the table coupler of the table section and the second coupler may be configured to couple with the mattress coupler of the mattress to secure the adapter board in place on the surgical table section. In some embodiments, the first coupler and the second coupler may be made from one of hook material and loop material.

It is contemplated that the adapter board may be formed to include a plurality of slots extending through the first side and the second side. Such an operating room table adapter may include at least one strap extending through at least one of the plurality of slots. The at least one strap may be configured to wrap around at least a portion of the surgical table section to secure the adapter board in place on the surgical table section.

The at least one rail may be spaced apart from the adapter board a distance sufficient for the table section to be situated between the adapter board and the at least one rail. The at least one rail may be movable relative to the adapter board.

It is contemplated that the operating room table adapter may include a handle. In such embodiments, the at least one rail may include a first rail and a second rail. The handle may be situated between the first rail and the second rail and the handle may be coupled to the first rail and the second rail for movement therewith. The operating room table adapter may include a rail receiver coupled to the adapter board. The rail receiver may include a first rail opening and a second rail opening. The first rail and the second rail opening may be sized to receive the first rail and the second rail, respectively. The size of the first rail opening may be adjustable to a released configuration allowing slidable movement of the first rail, the second rail, and the handle relative to the rail receiver and a clamped configuration preventing slidable movement of the first rail, the second rail, and the handle relative to the rail receiver. In some embodiments, the at least one rail may be coupled to a surgical head support apparatus and the surgical head support apparatus may be movable along the first rail.

The present disclosure also teaches a method of coupling an operating room table adapter to a surgical table having a table coupler on a table section. The method may include the steps of detaching at least a portion of a mattress supported on the table section from the table section so that a mattress coupler of the mattress detaches from the table coupler of the table section, positioning an adapter board on the table section so that a first coupler of the adapter board couples with the mattress coupler, and placing the portion of the mattress on the adapter board so that the table coupler couples with a second coupler of the adapter board.

It is contemplated that the method may include wrapping a strap around a portion of the surgical table to secure the table adapter to the surgical table. The strap may extend through a slot formed in the adapter board.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION

The detailed description particularly refers to the accompanying figures, in which.

Figure 1:
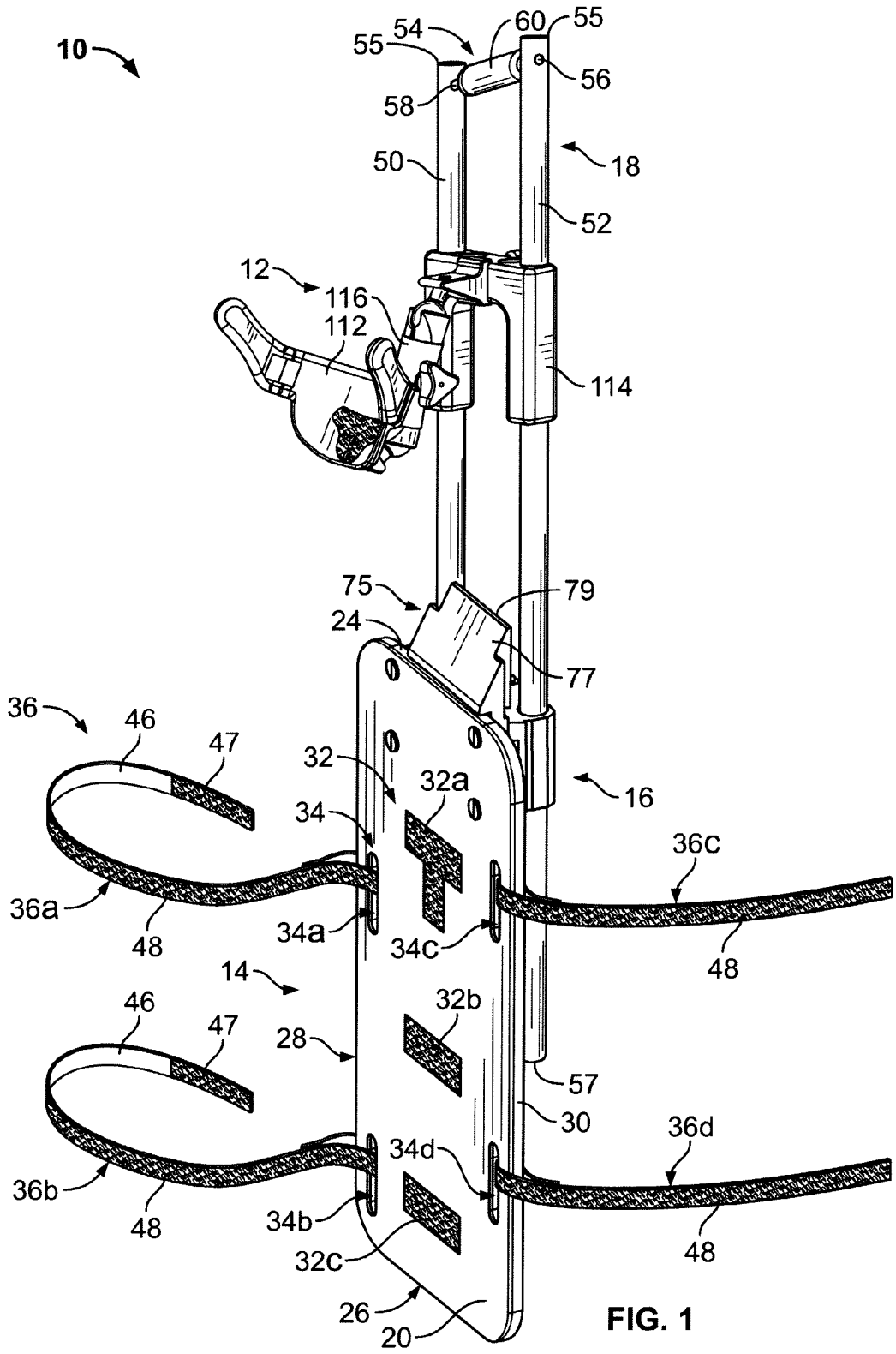
FIG. 1 is a perspective view of an operating room table adapter including an adapter board having patches made from hook material and a rail assembly, the rail assembly supporting a surgical head support apparatus above the adapter board.
Figure 6:
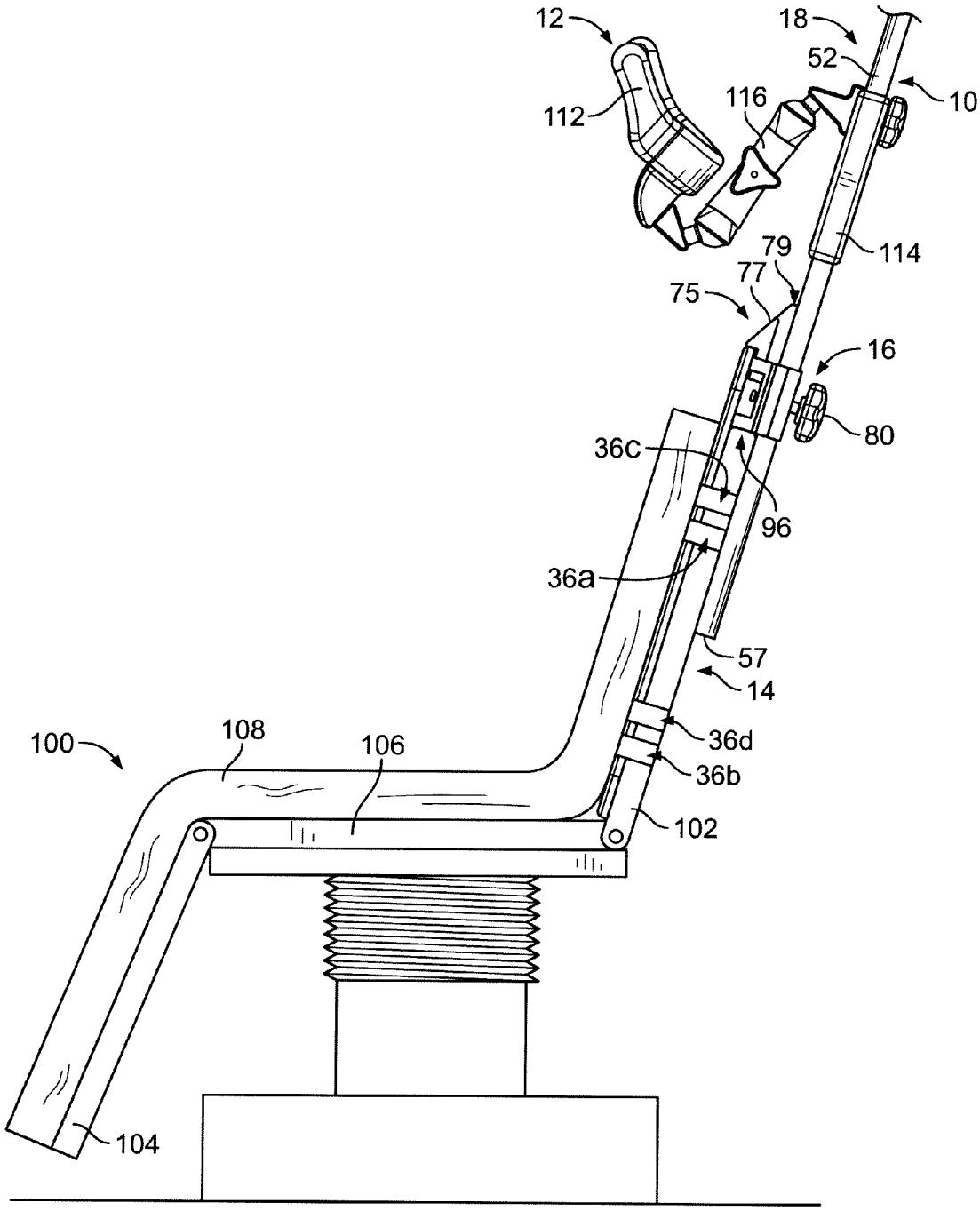
Figure 7:
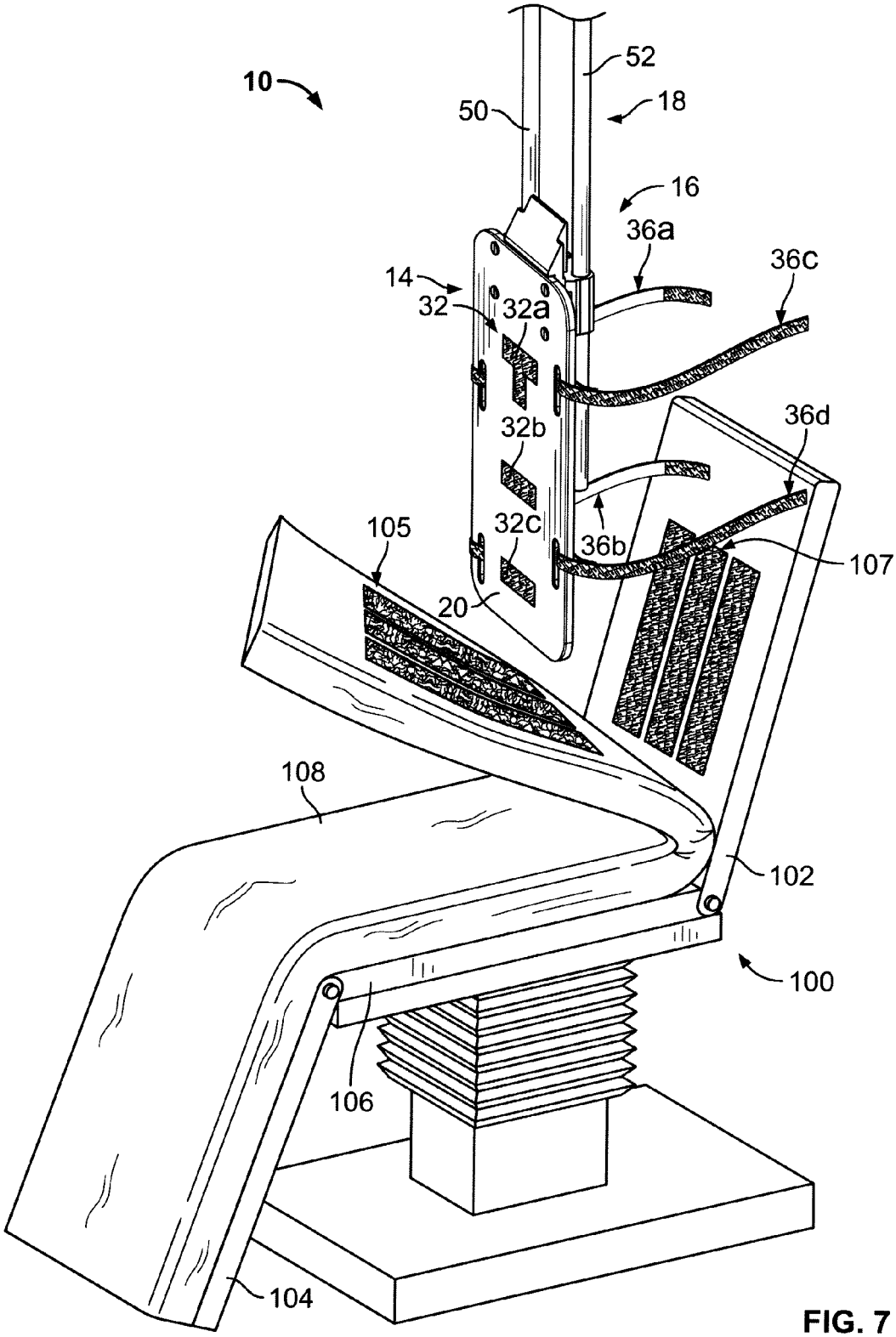

FIG. 6 is a side elevation view of the operating room table adapter of FIG. 1 with the adapter board situated between and coupled to a surgical table section and a mattress and the rail assembly coupled to a surgical head support apparatus; and FIG. 7 is a perspective view of the operating room table adapter of FIG. 1 with the adapter board situated between a surgical table section and a mattress with the mattress pulled away from the surgical table section.

DETAILED DESCRIPTION OF THE DRAWINGS

An operating room table adapter 10 includes an adapter board 14, a rail receiver 16, and a rail assembly 18 as shown in FIG. 1. A surgical head support apparatus 12 is coupled to the rail assembly 18 of the adapter 10 above the adapter board 14. The adapter board 14 has a front side 20 and a back side 22. The adapter board 14 is generally rectangular having a top edge 24, a bottom edge 26, and spaced apart first and second side edges 28, 30. The various edges 24, 26, 28, 30 meet at rounded corners in the illustrated example. The rail receiver 16 is coupled to the back side 22 of the adapter board 14. The rail assembly 18 is slidably coupled to the rail receiver 16 and extends beyond the top edge 24 of the adapter board 14.

The adapter board 14 also includes a plurality of couplers 32, a plurality of slots 34, and a plurality of straps 36. The plurality of couplers 32 includes front patches 32*a*, 32*b*, 32*c* and back patches 32*d*, 32*e*. The plurality of slots 34 includes slots 34*a*, 34*b*, 34*c*, 34*d* extending through the front side 22 and the back side 24 of the adapter board 14. The plurality of straps 36 includes straps 36*a*, 36*b*, 36*c*, 36*d*.

Figure 2:
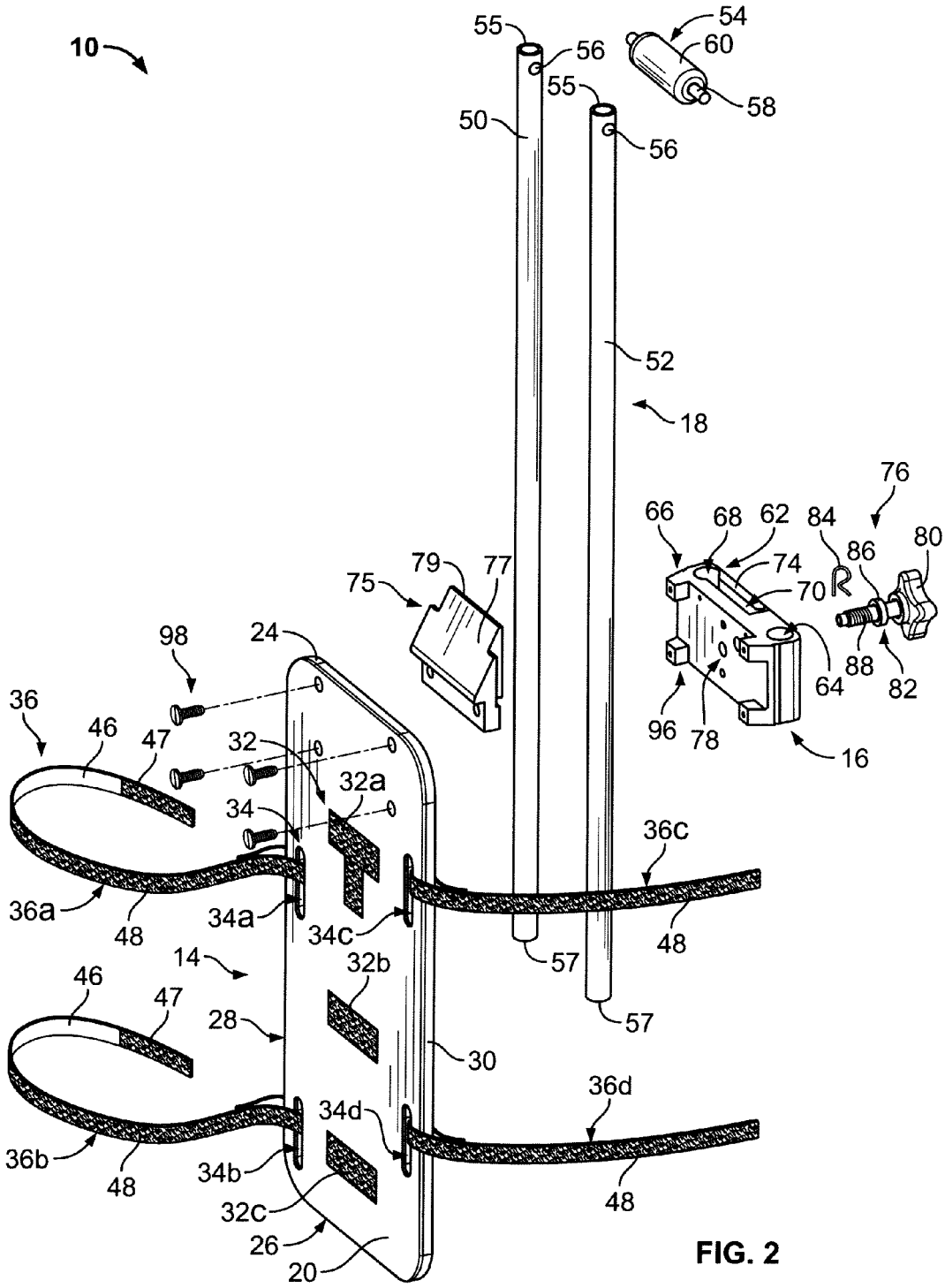
FIG. 2 is an exploded perspective view of the operating room table adapter of FIG. 1 showing the components of a rail receiver and the rail assembly detached from the adapter board.
Figure 3:
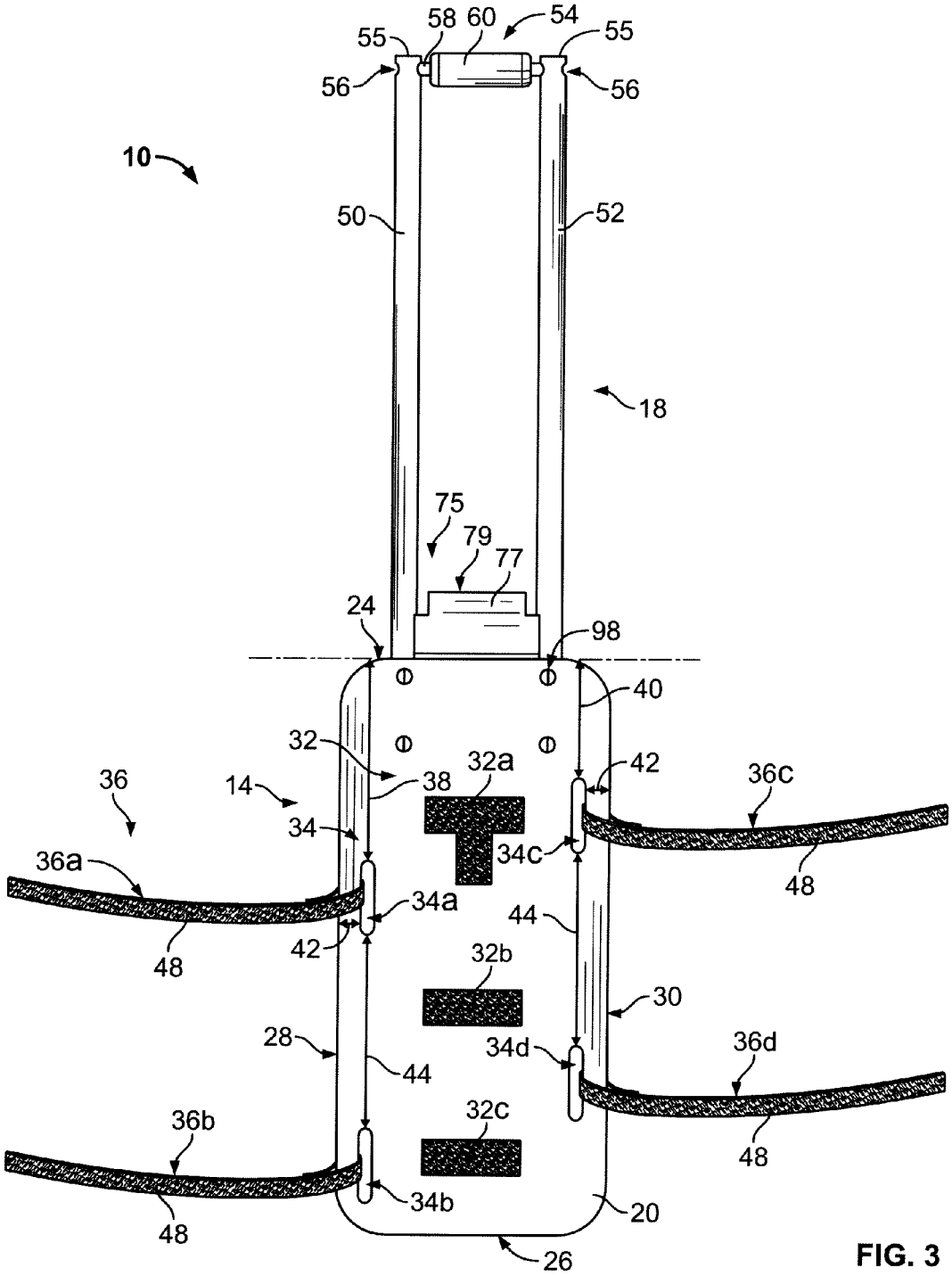
FIG. 3 is a front elevation view of the operating room table adapter of FIG. 1 showing the front patches of the adapter board and the second side of the straps.
Figure 4:
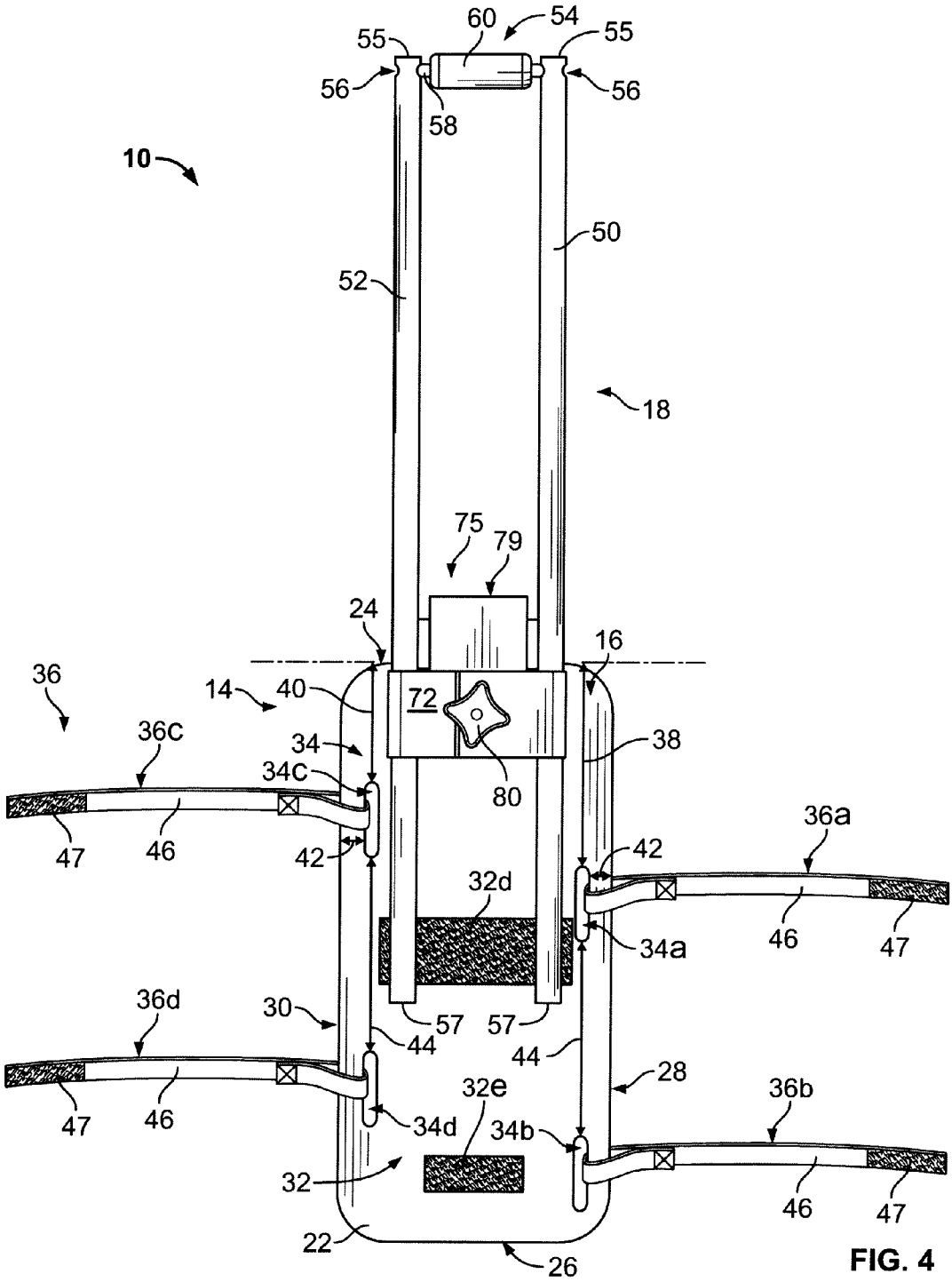
FIG. 4 is a rear elevation view of the operating room table adapter of FIG. 1 showing the back patches of the adapter board, the first side of the straps, and a portion of the rail assembly situated behind the adapter board.

The front patches 32*a*, 32*b*, 32*c* are illustratively made from hook material and face away from the front side 20 of the adapter board 14 as shown in FIGS. 1-3. In other embodiments, the front patches 32*a*, 32*b*, 32*c* may be made from loop material. The back patches 32*d*, 32*e* are illustratively made from loop material and face away from the back side 22 of the adapter board 14 as shown in FIG. 4. In other embodiments, the back patches 32*d*, 32*e* may be made from hook material. Front patch 32*a* is illustratively a T-shaped patch and patches 32*b*, 32*c*, 32*d*, 32*e* are illustratively rectangular. In other embodiments more or fewer couplers may be coupled to the adapter board 14 and may have other shapes.

As shown in FIGS. 3 and 4, the slot 34*a* is spaced a first distance 38 from the top edge 24 and the slot 34*c* is spaced a second distance 40 from the top edge 24. Slots 34*a*, 34*b*, 34*c*, 34*d* are each spaced a third distance 42 from the respective adjacent sides 28, 30. Further, slots 34*a*, 34*b* and slots 34*c*, 34*d* are spaced apart from one another a fourth distance 44. Thus, the slots 34*a*, 34*b*, 34*c*, 34*d* are contained in an imaginary parallelogram. In other embodiments, fewer or more slots may be formed through the adapter board 14 and the slots may be arranged in other configurations.

Each of the straps 36*a*, 36*b*, 36*c*, 36*d* extend through one corresponding slot 34*a*, 34*b*, 34*c*, 34*d*. Each of the straps 36*a*, 36*b*, 36*c*, 36*d* has a first side 46 and a second side 48. The first side 46 includes a loop material portion 47 as shown in FIGS. 1 and 4. The second side 48 is covered in hook material to be coupled to the loop material portion 48 of the first side as shown in FIGS. 1 and 3. In other embodiments, the straps 36*a*, 36*b*, 36*c*, 36*d* may extend through more than one slot 34*a*, 34*b*, 34*c*, 34*d* and may be coupled by other coupling means such as hooks or buckles. In some embodiments, the straps 36*a*, 36*b*, 36*c*, 36*d* may be extendable and retractable, or otherwise adjustable in length.

The rail assembly 18 includes a first rail 50, a second rail 52, and a handle 54 as shown in FIGS. 1-4. The first rail 50 and the second rail 52 are illustratively constructed from round tubes having a top end 55 and a bottom end 57. Both the first rail 50 and the second rail 52 are formed to include a handle hole 56 near the top end 55 and extending through the rails 50, 52. In some embodiments, the rails 50, 52 may be made from ¾" diameter round tubing and may be spaced apart 4½". The handle 54 includes a pin 58 and a hand hold 60. The pin 58 extends through the hand hold 60 and the hand hold 60 is free to rotate relative to the pin 58. The pin 58 extends through the handle hole 56 in the first rail 50 and the second rail 52 so that the hand hold 60 is situated between the first rail 50 and the second rail 52.

Figure 5:
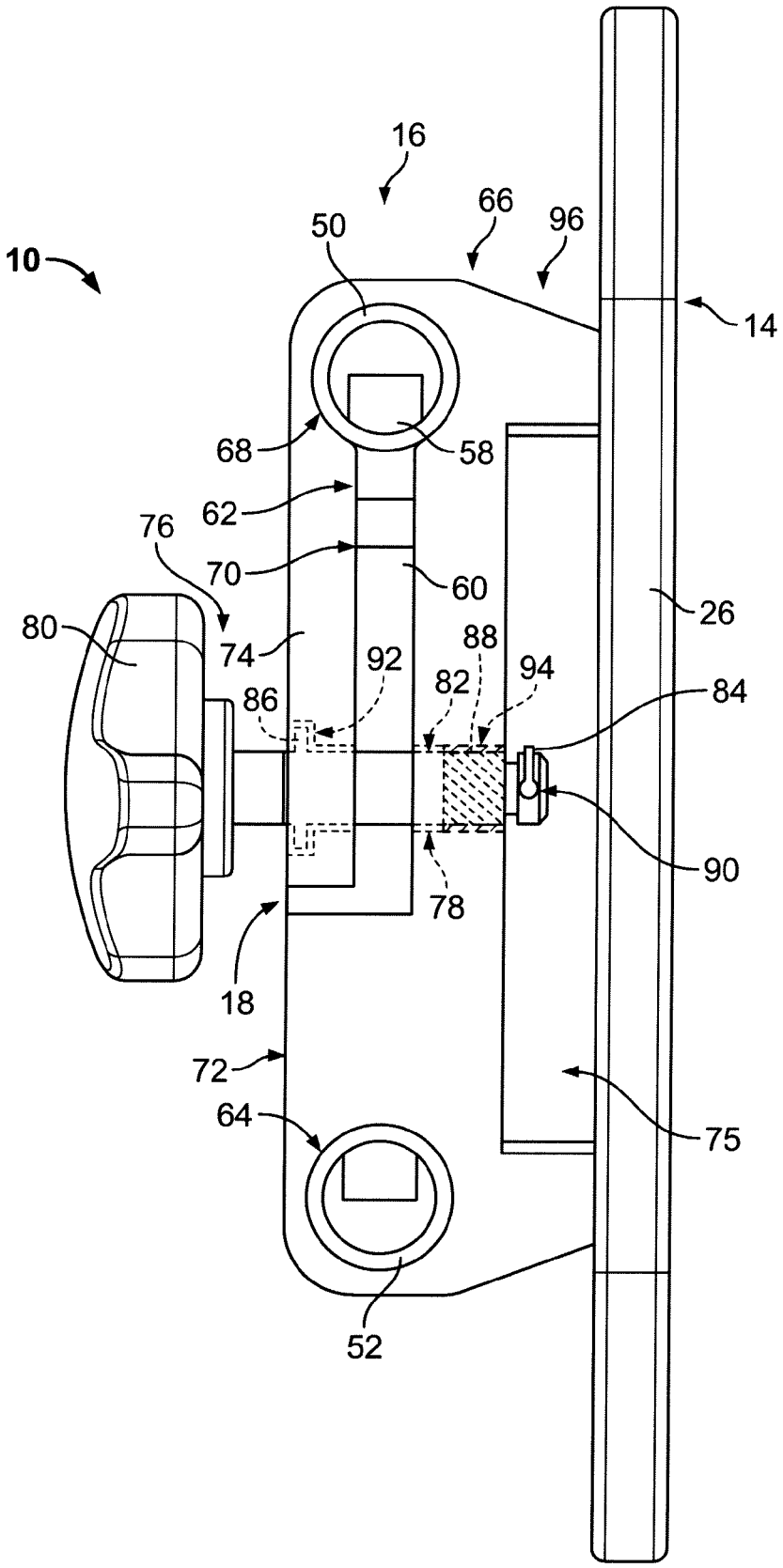
FIG. 5 is a bottom plan view of the operating room table adapter of FIG. 1 showing the details of the rail receiver including a first rail opening, a second rail opening, a lock bolt, and a lock hole.

The rail receiver 16 is formed to include a first rail opening 62, a second rail opening 64, and a receiver base 66 as shown in FIGS. 2 and 5. The first rail opening 62 extends through the rail receiver 16 and is formed to include a circular channel 68 connected to an L-shaped channel 70. The circular channel 68 is sized to receive the first rail 50. The L-shaped channel 70 extends through a back side 72 of the rail receiver 16 and forms an arm 74. The second rail opening 64 extends through the rail receiver 16 and is circular in cross-section. The second rail opening 64 is spaced apart from the first rail opening 62 and is sized to receive the second rail 52.

The rail receiver 16 also includes a receiver ramp 75, a lock bolt 76, and a lock hole 78 as shown in FIG. 2. The receiver ramp 75 is coupled to the receiver base 66 and extends above the top edge 24 of the adapter board 14 as shown in FIG. 1. The receiver ramp 75 forms a ramp 77 angling from the corner of the front side 20 and the top edge 24 of the adapter board 14 to a ramp crest 79 positioned above the top edge 24 of the adapter board 14 and behind the back side 22 of the adapter board 14.

As shown in FIGS. 2 and 5, the lock bolt 76 includes a lock knob 80, a bolt body 82, and a bolt retainer pin 84. The bolt body 82 has a shoulder 86, a threaded portion 88, and a retainer hole 90 as shown in FIG. 5. The shoulder 86 has a perimeter larger than the rest of the bolt body 82 and is situated between the lock knob 80 and the threaded portion 88. The threaded portion 88 is situated between the retainer hole 90 and the shoulder 86. The retainer hole 90 is sized to receive the bolt retainer pin 84.

The lock hole 78 extends through the arm 74 and the receiver base 66 as shown in FIG. 5. The lock hole 78 includes a shoulder 92 and threaded portion 94. The shoulder 92 is formed in the arm 74 and is sized to receive the shoulder 86. The threaded portion 94 is formed in the receiver base 66 and is sized to engage the threaded portion 88 of the lock bolt 76.

The lock bolt 76 adjusts the size of the first rail opening 62 moving the rail receiver 16 to a released configuration and to a clamped configuration. In the clamped configuration, the first rail opening 62 clamps down on the first rail 50 so that the rail assembly 18 is prevented from sliding relative to the rail receiver 16. In the released configuration, the first rail opening 62 is loosened to allow the rail assembly 18 to move relative to the rail receiver 16. To adjust the first rail opening 62 to the clamped position, the lock knob 80 is rotated clockwise causing the arm 74 to move closer to the receiver base 66 clamping the circular channel 68 of the first rail opening 62 on the first rail 50. To adjust the first rail opening 62 to the released configuration, the lock knob 80 is rotated counter-clockwise unclamping the circular channel 68 of the first rail opening 62 on the first rail 50. The bolt retainer pin 84 is inserted through the retainer hole 90 and prevents the lock bolt 76 from being removed from the lock hole 78 when the lock knob 80 is rotated in the counter-clockwise direction.

As shown in FIGS. 2 and 5, the receiver base 66 includes a plurality of feet 96. The plurality of feet include feet 96*a*, 96*b*, 96*c*, 96*d* situated between the rail openings 62, 64 and the adapter board 14. The plurality of feet 96 are coupled to the adapter board 14 by a plurality of screws 98.

FIG. 6 shows the adapter 10 coupled to a surgical table 100. The surgical table 100 includes a head section 102, a foot section 104, and a seat section 106 situated between the head section 102 and the foot section 104. The head section 102 is pivotably coupled to the seat section 106. The foot section 104 is also pivotably coupled to the seat section 106. In other embodiments, the adapter 10 may be coupled to an Allen® Table Powered Beach Chair (not shown).

The surgical table 100 also includes a mattress 108 supported on the head section 102, the foot section 104, and the seat section 106 of the surgical table 100. The mattress 108 includes a plurality of mattress couplers 105 located on the mattress 108 to face the head section 102 as shown in FIG. 7. In the illustrative embodiment, the mattress couplers 105 are patches of loop material.

The head section 102 of the surgical table 100 includes a plurality of table couplers 107 located on the head section 102 to face the mattress 108 as shown in FIG. 7. In the illustrative embodiment, the table couplers 107 are patches of hook material. When the operating room table adapter 10 is not present, the mattress couplers 105 are configured to engage the table couplers 107.

When the operating room table adapter 10 is coupled to the surgical table 100, the adapter board 14 is situated between the head section 102 of the surgical table 100 and the mattress 108. Additionally, the front patches 32*a*, 32*b*, 32*c* engage the mattress couplers 105 and the back patches 32*d*, 32*e* engage the table couplers 107. Further, the straps 36*a*, 36*b*, 36*c*, 36*d* are wrapped around the head section 102 of the surgical table 100 and the loop material portion 47 of the straps 36*a*, 36*b*, 36*c*, 36*d* engages the hook material on the second side 48. Thus, the adapter 10 is maintained in connection with the surgical table 100 by the plurality of couplers 32 and the plurality of straps 36. In some embodiments, the straps 36*a*, 36*b*, 36*c*, 36*d* may be wrapped around another part of the surgical table 100 such as a rail or an eyelet.

When a patient is supported on the surgical table 100 and the operating room table adapter 10 is coupled to the surgical table 100, the weight of the patient helps to further secure the adapter 10 to the table 100. When the weight of the patient presses down on surgical table 100, the adapter 10 is sandwiched between the mattress 108 and the head section 102. Thus, a patient supported on the surgical table 100 may contribute to maintaining connection of the adapter 10 to the surgical table 100.

When the operating room table adapter 10 is coupled to the surgical table 100, the head section 102 of the surgical table 100 is situated between the adapter board 14 and the rail assembly 18. Additionally, when the first rail opening 62 is in the released configuration, the rail assembly 18 is slidable relative to the rail receiver 16 and a portion of the rail assembly 18 may be situated behind the head section 102. Thus, a caregiver may choose to move a portion of the rail assembly 18 behind the head section 102 during surgery to reduce the distance that the adapter 10 extends beyond the surgical table 100.

The surgical head support apparatus 12 may be coupled to the rail assembly 18 as shown in FIG. 1 and includes a head support 112, a bracket 114, and a joint member 116. The joint member 116 couples the head support 112 to the bracket 114 so that the head support 112 is movable relative to the bracket 114 in three dimensions. Additional details regarding the surgical head support apparatus 12 are provided in U.S. Application Ser. No. 12/948,815 which is filed concurrently herewith, which is titled "Surgical Head Support Apparatus," and which is hereby incorporated by reference herein.

The bracket 114 of the surgical head support apparatus 12 is slidably coupled to the rail assembly 18. As the head section 102 of the surgical table 100 is pivoted relative to the seat section 106 of the surgical table 100, the surgical head support apparatus 12 is free to slide relative to the adapter 10. Thus, a caregiver does not be need to adjust the adapter 10 or the surgical head support apparatus 12 when the head section 102 of the surgical table 100 is pivoted relative to the seat section 106 of the surgical table.

The head support 112 of the surgical head support apparatus 12 is configured to be used with a padded head support. Additional details regarding the padded head support are provided in U.S. Application Ser. No. 12/948,818 which is filed concurrently herewith, which is titled "Padded Head Support for Surgery," and which is hereby incorporated by reference herein.

Although certain illustrative embodiments have been described in detail above, variations and modifications exist within the scope and spirit of this disclosure as described and as defined in the following claims.

The invention claimed is:

1. An operating room table adapter for use with a surgical table having a table coupler on a table section, the operating room table adapter comprising an adapter board including a first side having a first coupler and at least one slot formed through the adapter board, at least one rail coupled to the adapter board and extending beyond a first edge thereof, and at least one strap extending through the at least one slot, wherein the first coupler is configured to engage the table coupler of the table section and the at least one strap is configured to wrap around at least a portion of the surgical table section to secure the adapter board in place on the surgical table section, and wherein the adapter board includes a second side opposing the first side and the strap extends through the first side and the second side.

2. An operating room table adapter for use with a surgical table having a table coupler on a table section, the operating room table adapter comprising an adapter board including a first side having a first coupler and at least one slot formed through the adapter board, at least one rail coupled to the adapter board and extending beyond a first edge thereof, and at least one strap extending through the at least one slot, wherein the first coupler is configured to engage the table coupler of the table section and the at least one strap is configured to wrap around at least a portion of the surgical table section to secure the adapter board in place on the surgical table section, wherein the adapter board includes a second side opposing the first side and at least two slots, the first slot extending through the first side and the second side of the adapter board and spaced a first distance from the first edge of the adapter board, the second slot extending through the first side and the second side of the adapter board and spaced a second distance from the first edge of the adapter board, and the first distance not equal to the second distance, and wherein the adapter board includes a second edge substantially parallel to the first edge, the first slot being spaced a third distance from the second edge, the second slot being spaced a fourth distance from the second edge, and the third distance being less than the fourth distance.

3. An operating room table adapter for use with a surgical table having a table coupler on a table section, the operating room table adapter comprising an adapter board including a first side having a first coupler and at least one slot formed through the adapter board, at least one rail coupled to the adapter board and extending beyond a first edge thereof, and at least one strap extending through the at least one slot, wherein the first coupler is configured to engage the table coupler of the table section and the at least one strap is configured to wrap around at least a portion of the surgical table section to secure the adapter board in place on the surgical table section, further comprising a rail receiver coupled to the adapter board and having a rail opening sized to receive the at least one rail, and wherein the size of the rail opening is adjustable to a released configuration allowing slidable movement of the at least one rail relative to the rail opening and to a clamped configuration preventing slidable movement of the at least one rail relative to the rail opening.

4. The operating room table adapter of claim 3, wherein the rail receiver includes a rail lock having a lock bolt, the lock bolt rotatable to adjust the size of the rail opening to the clamped configuration and to the released configuration.

5. An operating room table adapter for use with a surgical table having a table coupler on a table section, the operating room table adapter comprising an adapter board including a first side having a first coupler and at least one slot formed through the adapter board, at least one rail coupled to the adapter board and extending beyond a first edge thereof, and at least one strap extending through the at least one slot, wherein the first coupler is configured to engage the table coupler of the table section and the at least one strap is configured to wrap around at least a portion of the surgical table section to secure the adapter board in place on the surgical table section, further comprising a rail receiver coupled to the adapter board and having a rail opening sized to receive the at least one rail, and wherein the rail opening is spaced apart from the adapter board a distance sufficient for the table section to be situated between the adapter board and the at least one rail.

6. An operating room table adapter for use with a surgical table having a table coupler on a table section and a mattress having a table coupler on a surface of the mattress, the operating room table adapter comprising an adapter board including a first side having a first coupler and a second side having a second coupler, at least one rail coupled to the adapter board and extending beyond a first edge thereof, wherein the first coupler is configured to engage with the table coupler of the table section and the second coupler is configured to couple with the table coupler of the mattress to secure the adapter board in place on the surgical table section, and wherein the first coupler is made from one of hook material and loop material and the second coupler is made from one of hook material and loop material.

7. An operating room table adapter for use with a surgical table having a table coupler on a table section and a mattress having a table coupler on a surface of the mattress, the operating room table adapter comprising an adapter board including a first side having a first coupler and a second side having a second coupler, at least one rail coupled to the adapter board and extending beyond a first edge thereof, wherein the first coupler is configured to engage with the table coupler of the table section and the second coupler is configured to couple with the table coupler of the mattress to secure the adapter board in place on the surgical table section, and wherein the at least one rail is spaced apart from the adapter board a distance sufficient for the table section to be situated between the adapter board and the at least one rail and the at least one rail is movable relative to the adapter board.

8. The operating room table adapter of claim 7, further comprising a handle wherein the at least one rail includes a first rail and a second rail and the handle is situated between the first rail and the second rail, and the handle is coupled to the first rail and the second rail for movement therewith.

9. The operating room table adapter of claim 8, further comprising a rail receiver coupled to the adapter board, the rail receiver including a first rail opening sized to receive the first rail, a second rail opening sized to receive the second rail, the first rail opening size being adjustable to a released configuration allowing slidable movement of the first rail, the second rail, and the handle relative to the rail receiver and a clamped configuration preventing slidable movement of the first rail, the second rail, and the handle relative to the rail receiver.

10. The operating room table adapter of claim 7, wherein the wherein the at least one rail is coupled to a surgical head support apparatus, the surgical head support apparatus movable along the first rail.

11. The operating room table adapter of claim 7, further comprising at least one strap and the adapter board formed to include at least one slot extending through the first side and the second side of the adapter board, wherein the at least one strap extends through the at least one slot and the at least one strap is configured to wrap around at least a portion of the surgical table section to secure the adapter board in place on the surgical table section.

12. The operating room table adapter of claim 7, wherein the adapter board is formed to include a plurality of slots extending through the first side and the second side.

13. The operating room table adapter of claim 12, further comprising at least one strap extending through at least one of the plurality of slots and configured to wrap around at least a portion of the surgical table section to secure the adapter board in place on the surgical table section.

14. A method of coupling an operating room table adapter to a surgical table having a table coupler on a table section, the method comprising detaching at least a portion of a mattress supported on the table section from the table section so that a mattress coupler of the mattress detaches from a table coupler of the table section, positioning an adapter board on the table section so that a first coupler of the adapter board couples with the mattress coupler, and placing the portion of the mattress on the adapter board so that a second coupler of the adapter board couples with the table coupler.

15. The method of claim 14, further comprising wrapping a strap around a portion of the surgical table to secure the table adapter to the surgical table.

16. The method of claim 15, wherein the strap extends through a slot formed in the adapter board.

* * * * *